US009885151B2

(12) United States Patent
Schmitt

(10) Patent No.: US 9,885,151 B2
(45) Date of Patent: Feb. 6, 2018

(54) PRESS ARRANGEMENT

(71) Applicant: VOITH PATENT GMBH, Heidenheim (DE)

(72) Inventor: Matthias Schmitt, Munich (DE)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 15/315,830

(22) PCT Filed: Jun. 2, 2015

(86) PCT No.: PCT/EP2015/062197

§ 371 (c)(1),
(2) Date: Dec. 2, 2016

(87) PCT Pub. No.: WO2015/185524

PCT Pub. Date: Dec. 10, 2015

(65) Prior Publication Data

US 2017/0114498 A1 Apr. 27, 2017

(30) Foreign Application Priority Data

Jun. 2, 2014 (DE) ..... 10 2014 210 368

(51) Int. Cl.

| | |
|---|---|
| ***D21F 3/06*** | (2006.01) |
| ***D21F 3/04*** | (2006.01) |
| ***D21F 3/08*** | (2006.01) |

(52) U.S. Cl.

CPC ..... *D21F 3/06* (2013.01); *D21F 3/045* (2013.01); *D21F 3/08* (2013.01)

(58) Field of Classification Search

CPC .... D21F 3/04; D21F 3/06; D21F 3/08; D21G 1/02

USPC ..... 162/263

See application file for complete search history.

(56) References Cited

U.S. PATENT DOCUMENTS

| | | | |
|---|---|---|---|
| 5,562,027 | A | 10/1996 | Moore |
| 9,302,871 | B2 | 4/2016 | Breineder et al. |
| 2004/0244609 | A1 | 12/2004 | Muhs |
| 2013/0345035 | A1 | 12/2013 | Berendes et al. |

FOREIGN PATENT DOCUMENTS

| | | | |
|---|---|---|---|
| DE | 69627639 | T2 | 5/2004 |
| DE | 102005044014 | A1 | 3/2007 |
| DE | 202012012490 | U1 | 2/2013 |
| DE | 102012202245 | A1 | 8/2013 |
| WO | 9625288 | A1 | 8/1996 |
| WO | 2013104600 | A1 | 7/2013 |

*Primary Examiner* — Mark Halpern

(74) *Attorney, Agent, or Firm* — Laurence A. Greenberg; Werner H. Stemer; Ralph E. Locher

(57) ABSTRACT

A press arrangement for a machine for producing and/or processing a fibrous web, in particular a paper, board or tissue web. The arrangement has at least a central roll and a first and a second mating pressing unit. The first mating pressing unit forms a first press nip with the central roll, and the second mating pressing unit forms a second press nip with the central roll. The central roll has a plurality of pressure sensors embedded in the central roll and arranged beside one another in the cross-machine direction, by way of which the pressure profile in the cross-machine direction can be determined in the first and in the second press nip. There is also disclosed a method for operating such a press arrangement.

18 Claims, 2 Drawing Sheets

PRESS ARRANGEMENT

This application is a 371 of PCT/EP2015/062197 filed 2 Jun. 2015

BACKGROUND OF THE INVENTION

Field of the Invention

The invention relates to a press arrangement for a machine for producing and/or processing a fibrous web, in particular a paper, board or tissue web, having a central roll and a first and a second mating pressing unit, wherein the first mating pressing unit forms a first press nip with the central roll, and the second mating pressing unit forms a second press nip with the central roll.

Press arrangements having a central roll on which two or more press nips are formed place high requirements from many points of view on the setting of the most exact possible pressure distribution in the cross-machine direction for both press nips. The ability to exactly measure the real pressure distribution in the press nip is important here, since, as a result of erroneous calibration, the hydraulic pressure with which a press roll is moved against the central roll or the hydraulic pressure of the pressure ram of a shoe press roll or controlled deflection roll can often differ from the pressure distribution really established in the press nip.

From the prior art document WO2013/104600, it is known to use pressure sensors for measuring a pressure profile in a roll nip. The pressure sensors, including their evaluation unit and their installation in a roll, are expensive, however, for which reason currently many press nips are not yet provided with pressure sensors.

BRIEF SUMMARY OF THE INVENTION

It is therefore desirable to propose a press arrangement for a machine producing and/or processing a fibrous web and having a central roll providing at least two press nips, with which the pressure distribution in the at least two press nips can be measured in the most simple and reliable manner.

The object is achieved by a press arrangement comprising at least one central roll and a first and second mating pressing unit, in which the first mating pressing unit forms a first press nip with the central roll, and the second mating pressing unit forms a second press nip with the central roll, and in which the central roll comprises a plurality of pressure sensors embedded in the central roll and arranged beside one another in the cross-machine direction, by means of which the pressure profile in the cross-machine direction of the central roll can be determined in the first and in the second press nip.

According to a second aspect of the invention, the object is achieved by a method for measuring the pressure profile in the cross-machine direction in a press arrangement comprising at least two press nips and belonging to a machine for producing and/or processing a fibrous web, wherein a first press nip is formed between a first mating pressing unit and a central roll, and a second press nip is formed between a second mating pressing unit and the central roll, and the central roll has a plurality of pressure sensors arranged beside one another in the cross-machine direction and embedded in said central roll, wherein the method comprises the following steps:

a. rotating the central roll so that the pressure sensors pass the first and second press nip, b. measuring the pressure profile in the first and in the second press nip by means of the pressure sensors.

Consequently, during rotational movement of the central roll, each of the sensors arranged in the cross-machine direction successively passes the press nips and, as it passes through the respective press nip, outputs a pressure signal which can be or is assigned to the respective press nip and the pressure sensor. In this way, for each position in the cross-machine direction at which a pressure sensor is positioned, the pressure in the press nip can be/is determined by the chronologically successive passage of the respective pressure sensor through the respective press nip.

By means of the solution according to the invention, by means of an arrangement of a plurality of pressure sensors embedded in the central roll and co-rotating with the central roll, the pressure distribution in the cross-machine direction can thus be measured in any press nip which is formed between the central roll and a mating pressing element set against the latter. In this way, the pressure profile in the cross-machine direction of a plurality of press nips can be determined by using a sensor arrangement in only one roll, namely the central roll. The solution according to the invention is therefore simple and economical and permits accurate determination of the pressure profile in any press nip formed with the central roll.

Advantageous refinements and developments of the invention are specified in the sub-claims.

If at least one of the mating pressing units is, for example, a controlled deflection press roll or a shoe press roll, the method can comprise the further step of determining the hydraulic pressure of the holding arms of the mounting of the bearing journals and/or the supporting rams for supporting the roll shell with respect to the supporting yoke of the mounting of the controlled deflection press roll or shoe press roll and, if appropriate, displaying the hydraulic pressure determined and the pressure distribution measured with the pressure sensors.

According to a preferred development of the invention, provision is made for the plurality of pressure sensors to be fiber-optic pressure sensors, in particular Bragg grating sensors. Bragg grating sensors are suitable from many points of view for use in the solution according to the invention, since these have short reaction times and are therefore able to resolve in a short time successive measured signals which are produced by nip passages following one another quickly.

Preferably, at least some, in particular all, of the Bragg grating sensors have a mutually different Bragg wavelength. By means of a Bragg wavelength that differs from the other Bragg wavelengths, a Bragg grating sensor can be identified unambiguously, specifically irrespective of whether or not this goes through the press nip at the same time as other Bragg grating sensors of another Bragg wavelength. From this point of view, the Bragg grating sensors having a mutually different Bragg wavelength are far superior to the known piezo pressure sensors or film pressure sensors, since in the last-named the local resolution is produced by the order of the measured signals which are generated as a result of the fact that not all the sensors go through the respective press nip at the same time. To this end, it was often proposed in the past to arrange these pressure sensors (film or piezo) along a path running helically on the circumferential surface of the roll. In particular when the pressure sensors are used in a central roll, however, it is possible for difficulties with regard to the separation of the pressure signals from different piezo or film pressure sensors to occur, specifically when different sensors go through different press nips at the same time because of their helical arrangement. This can be the case in particular when the two press nips, viewed in the circumferential direction of the central roll, are placed close beside each other. This problem can be avoided by the use of Bragg grating sensors with mutually different Bragg wavelengths.

In order to assign the pressure signals measured by using the pressure sensors to the respective press nip, it can be is in particular expedient if the rotational position of the pressure sensors is determined with the aid of a trigger signal during rotational movement of the central roll. In other words, during each revolution of the central roll, a trigger signal is generated, with the aid of which the position of each of the pressure sensors in the circumferential direction of the central roll is or can be determined. In order to generate the trigger signal, a Hall sensor is particularly suitable, the signals from which have a very steep flank, which means that the rotational position of the roll can be determined with high precision.

The determination of the rotational position of the roll with high precision offers manifold advantages. Thus, for example, in many applications the individual sensors are not distributed over the entire circumference of the roll but are located in a sector the angle φ of which is less than 90°, preferably less than 45°, particularly preferably less than 20°, quite particularly preferably less than 10°. In the extreme case, the sensors can also be located on a line in the CD direction. Since the rotational position of the roll can be determined very accurately, it is for example possible that measured values from the sensors are then evaluated only when the angular region φ is located within a nip. Thus, a faster measurement is possible, since only relatively little data has to be processed.

At least some, in particular all, of the plurality of pressure sensors can be connected by means of at least one signal line to a signal excitation unit and/or to a signal evaluation unit.

In practical terms, at least one optical fiber can be provided, wherein the at least one optical fiber comprises sections without Bragg grating sensors and sections formed as Bragg grating sensors, and in each case between two adjacent sections without Bragg grating sensors there is arranged a section formed as a Bragg grating sensor, and vice versa. In this case, each section with a Bragg grating sensor provides a pressure sensor and each section without a Bragg grating sensor provides part of the at least one signal line. Such an optical fiber therefore provides an arrangement of multiple Bragg grating sensors connected in series. Signal lines formed from the optical fibers and pressure sensors are particularly to be preferred, since—as compared with piezo or film pressure sensors—these are considerably smaller and therefore disrupt the construction of the central roll less than the last-named.

In practical terms, a plurality of optical fibers, to which the Bragg grating sensors are distributed, can be provided. This can mean that a first optical fiber provides a first arrangement of Bragg grating sensors arranged in series, and a second optical fiber provides a second arrangement of Bragg grating sensors arranged in series.

Different possible ways as to how the central roll can be constructed are conceivable. Thus, it is conceivable that the central roll has a roll core and a cover substantially covering the circumferential surface of the roll core. However, it is also conceivable that the central roll has no cover; instead the metallic circumferential surface of the roll core of the central roll comes directly into contact with a fabric or the fibrous web.

Here, the cover can have a functional layer located radially on the outside, which can be brought into contact with the fibrous web or with a fabric, wherein the functional layer can be, for example, a polymer or a ceramic or a metallic functional layer.

A polymer functional layer can preferably contain, for example as a substantial constituent, preferably more than 60%, particularly preferably 80% or more, epoxy resin, polyurethane, natural rubber or mixtures thereof. As further constituents, the polymer functional layer can contain particulate and/or fibrous filler. If the polymer functional layer has epoxy resin as a substantial constituent, the latter can be fiber-reinforced, wherein glass fibers for example are suitable as reinforcing fibers.

The ceramic or metallic functional layer can be produced, for example, by a thermal coating process. A thermal coating process or spraying process is understood to be a surface coating process in which, as per the definition of DIN EN 657, additives, the so-called spraying additives, are melted or fused inside or outside a spray gun, are accelerated in a gas stream in the form of spray particles and thrown onto the surface of the components to be coated.

The ceramic functional layer can also contain, as substantial constituent, a metal-oxide compound or a metal-carbide compound or a metal-nitride compound or be formed therefrom. For example, a chromium-oxide compound is suitable as a metal-oxide compound.

In the case of a ceramic or metallic functional layer produced by thermal coating, because of the temperatures of more than 200° C. which often occur, it may be expedient that, when Bragg grating sensors are used, the optical fiber or fibers are made of a more highly temperature-resistant material, such as sapphire glass, for example.

The metallic covering layer can be, for example, a functional layer which contains, as a substantial component, chromium or tungsten or molybdenum or niobium or boron or nickel or a mixture or alloy thereof, or is formed therefrom.

In addition to the functional layer, the cover can also have an adhesive layer arranged radially between the roll core and the functional layer.

Depending on the actual application of the press arrangement, the pressure sensors can be arranged at various radial positions of the central roll. Thus, it is conceivable, for example, that the pressure sensors are embedded in the cover or between the cover and the roll core.

If the pressure sensors are embedded in the cover, then these can be arranged in the functional layer of the cover or between functional layer and adhesive layer of the cover.

For some applications, such as for example in the case of a cover with a ceramic or metallic functional layer, it may be expedient if, in the roll core or in the cover, a groove is provided, in which the pressure sensors, in particular Bragg grating sensors, and the signal line, in particular sections of the optical fiber without Bragg grating sensors, are arranged. This may be expedient in particular in the combination of pressure sensors which are formed as Bragg grating sensors with optical fibers and production of the functional layer by a thermal coating process, since during the latter high mechanical forces act on the optical fiber or fibers and the latter are mechanically very vulnerable.

It is conceivable that a first number of the pressure sensors are arranged in a first region extending in the cross-machine direction over substantially the working width of the central roll, the extent of said region in the circumferential direction being less than 30 cm, preferably less than 15 cm, particularly preferably less than 5 cm. The working width of the central roll is to be understood to be the length thereof in the cross-machine direction, on which the fibrous web is guided.

In this case, the first number of pressure sensors goes relatively simultaneously through the respective press nip. In this connection, the term "substantially the working width" is intended to mean at least 70%, preferably at least 80%, of the working width.

Furthermore, it is conceivable that a second number of pressure sensors are arranged in a second region extending in the cross-machine direction over substantially the working width of the central roll, the extent of said region in the circumferential direction being less than 30 cm, preferably less than 15 cm, particularly preferably less than 5 cm, wherein the first and second region, viewed in the circumferential direction, are arranged to be offset from each other by at least 45°±10°, preferably at least 90°±10°, particularly preferably by 180°±20°.

By means of a combination of this and the preceding embodiment, during each rotational movement of the central roll, at least two pressure measured values are recorded for each press nip at each sensor position in the cross-machine direction. In this way, in particular given suitable evaluation of the measured values, it is possible to measure the pressure profile for each sensor in the cross-machine direction. As a result, it is then possible to obtain a pressure profile in the machine direction and in the cross-machine direction.

As an alternative thereto, however, it is also conceivable that the first number of pressure sensors is arranged to run helically in relation to the circumferential surface of the central roll, or to be arranged on the latter non-uniformly in relation to each other, spaced apart in the circumferential direction and in the cross-machine direction.

In particular in some cases to be able to determine deformations of the central roll or of the mating pressing elements or else "jumps" in the nip pressure occurring in the edge region of the fibrous web in the edge region of the working width of the central roll, viewed in the cross-machine direction, according to a preferred refinement of the invention, provision can be made for the distance between the pressure sensors in the edge region of the working width of the central roll, viewed in the cross-machine direction, to be lower than outside the edge region, i.e. for example in the central region between the two edge regions.

The central roll is preferably not a controlled deflection roll or shoe press roll. The central roll is preferably not driven.

With regard to the actual configuration of the mating pressing elements, an extremely wide range of combinations is possible. Thus, at least one of the two mating pressing units of the first and second mating pressing unit can be a press roll or a shoe press roll. Furthermore, at least one of the press rolls can be a controlled deflection roll.

Furthermore, both of the two mating pressing units of the first and second mating pressing unit can be press rolls. In this case it is conceivable that the one of the two mating pressing units of the first and second mating pressing unit is a controlled deflection press roll, and the other of the two mating pressing units of the first and second mating pressing unit is not a controlled deflection roll. It is conceivable that at least one of the two press rolls, in particular both press rolls, is/are driven. This is expedient in particular when the central roll is not driven.

Alternatively to this, it is possible that the one of the two mating pressing units of the first and second mating pressing unit is a press roll, and the other of the two mating pressing units of the first and second mating pressing unit is a shoe press roll.

BRIEF DESCRIPTION OF THE SEVERAL VIEWS OF THE DRAWING

The invention will be explained further below by using schematic drawings, in which.

DESCRIPTION OF THE INVENTION

Figure 1:
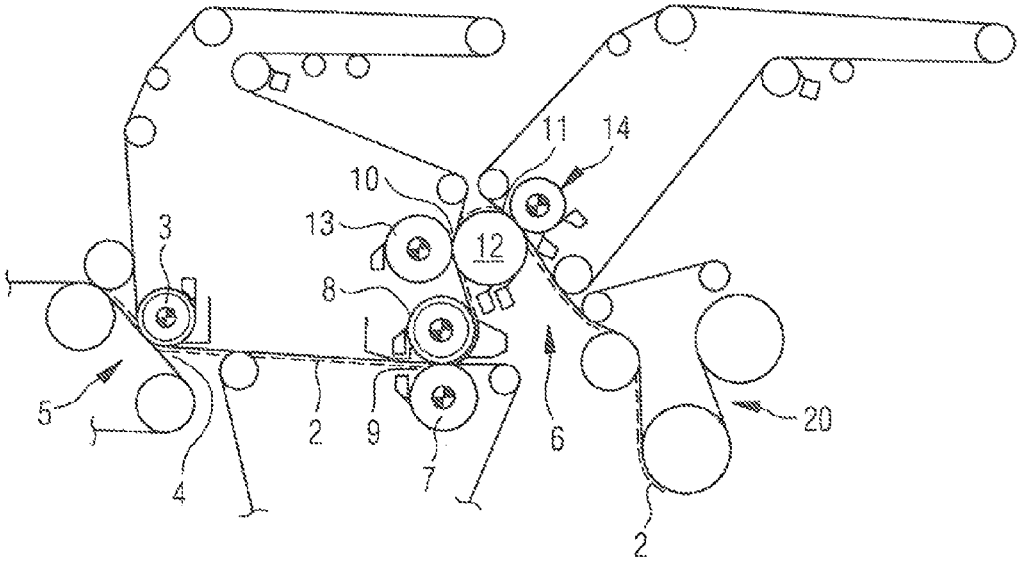
FIG. 1 shows a first embodiment of a press arrangement according to the invention.

FIG. 1 shows a first embodiment of a press arrangement 6 according to the invention from a paper machine 1.

A fibrous web 2 is transferred from a forming section 5 into the press arrangement 6 at a prick-up point 4 comprising a pick-up roll 3. The press arrangement 6 has a press nip 9 formed by two press rolls 7, 8, through which the fibrous web 2 runs first, before the latter is led through a first press nip 10 and a second press nip 11 of a central roll arrangement, in which a central roll 12 forms the first press nip 10 with a first mating pressing element formed as a press roll 13 and forms the second press nip 11 with a second mating pressing element formed as a press roll 14.

In the present case, the press rolls 7, 8, 13 and 14 are driven, whereas the central roll 12 is not driven. The press roll 13 is also a controlled deflection press roll. The central roll 12 has a roll cover 15 with a polymer functional layer 16 made of glass fiber-reinforced epoxy resin and an adhesive layer 18 arranged radially between the roll core 17 and the functional layer 16.

The material of the other roll covers of the other rolls can, for example, comprise polyurethane and/or natural rubber as a substantial constituent.

According to the invention, the central roll 12 has a plurality of pressure sensors 19 embedded in the central roll 12 and arranged beside one another in the cross-machine direction, by means of which the pressure profile in the cross-machine direction can be determined in the first and in the second press nip 10, 11.

Figure 3:
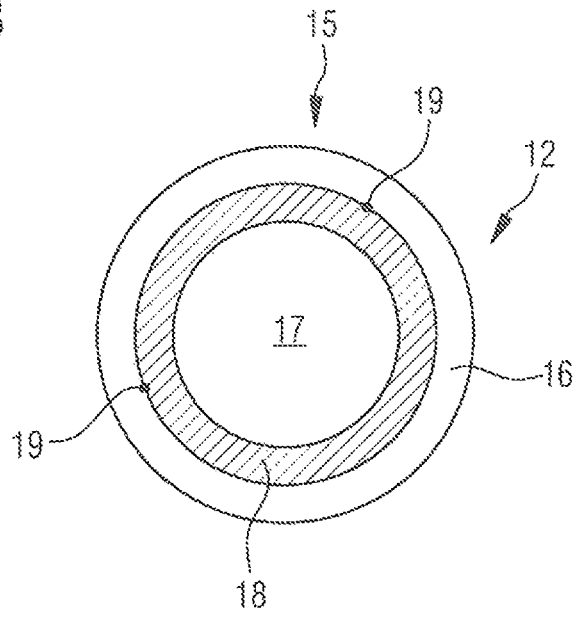
FIG. 3 shows a detailed illustration of the central roll from FIG. 1.

As can be seen from the detailed illustration of FIG. 3, the pressure sensors 19 are arranged between the functional layer 16 and the adhesive layer 18 of the cover 15.

In the present case, the pressure sensors 19 are Bragg-grating sensors which all have a mutually different Bragg wavelength.

After the passage of the fibrous web 2 through the first and second press nip 10, 11 of the central roll arrangement, the fibrous web 2 is transferred into a drying section 20.

Figure 2:
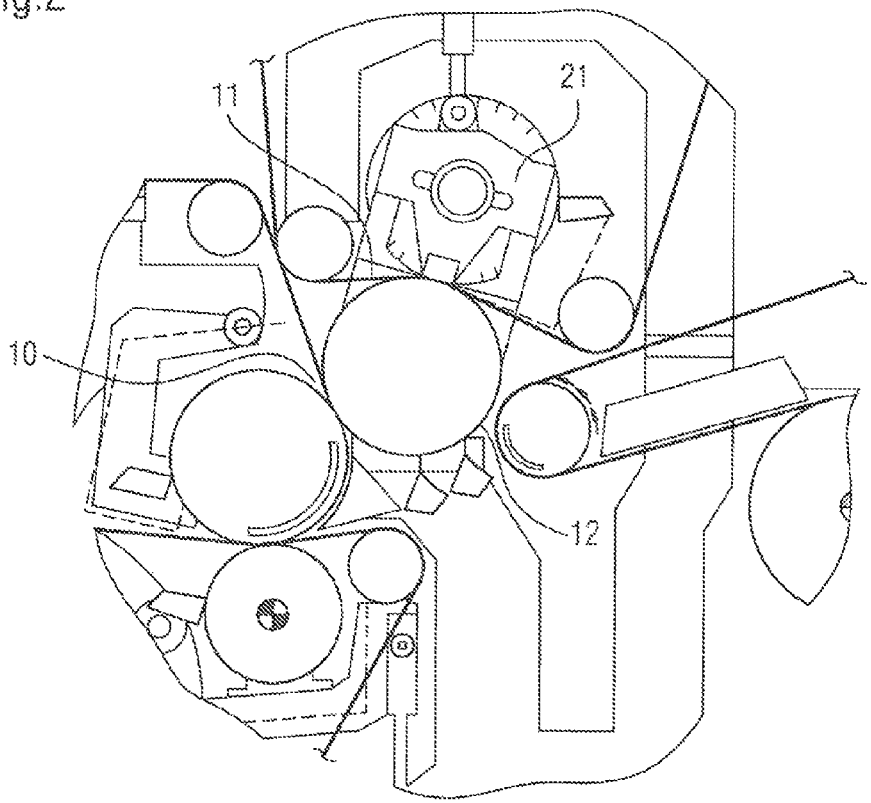
FIG. 2 shows a second embodiment of a press arrangement according to the invention.

The embodiment of FIG. 2 differs substantially from the embodiment of FIG. 1, in that the second press nip 11 of the central roll arrangement is formed by a shoe press roll 21 and the central roll 12, and by the fact that the central roll 12 a cover with a ceramic functional layer 16 of chromium oxide, which has been produced by a thermal spraying process.

The invention claimed is:

1. A press arrangement for a machine for producing and/or processing a fibrous web, comprising:

a central roll;

a first mating pressing unit disposed to form a first press nip with said central roll;

a second mating pressing unit disposed to form a second press nip with said central roll;

a plurality of pressure sensors embedded in said central roll and arranged beside one another in a cross-machine direction, said pressure sensors being configured to determine a pressure profile in the cross-machine direction in said first press nip and in said second press nip; and a Hall sensor disposed to issue a trigger signal during a rotation of said central roll for determining a rotational position of said pressure sensors during rotational movement of said central roll.

2. The press arrangement according to claim 1, wherein said pressure sensors are fiber-optic pressure sensors.

3. The press arrangement according to claim 2, wherein said fiber-optic pressure sensors are Bragg grating sensors.

4. The press arrangement according to claim 3, wherein all said Bragg grating sensors have a mutually different Bragg wavelengths.

5. The press arrangement according to claim 2, wherein at least one optical fiber is provided, wherein the at least one optical fiber comprises sections without Bragg grating sensors and sections formed as Bragg grating sensors, and in each case between two adjacent sections without Bragg grating sensors there is arranged a section formed as a Bragg grating sensor, and vice versa, and wherein each section with a Bragg grating sensor provides a pressure sensor and each section without a Bragg grating sensor provides part of at least one signal line connecting said pressure sensors to a signal excitation unit and/or to a signal evaluation unit.

6. The press arrangement according to claim 1, wherein said plurality of pressure sensors are connected by way of at least one signal line to a signal excitation unit and/or to a signal evaluation unit.

7. The press arrangement according to claim 1, wherein said central roll comprises a roll core and a cover substantially covering a circumferential surface of said roll core.

8. The press arrangement according to claim 7, wherein said cover has a functional layer located radially on the outside, to be brought into contact with the fibrous web or with a fabric of the machine for producing and/or processing the fibrous web.

9. The press arrangement according to claim 8, wherein said functional layer is selected from the group consisting of a polymer functional layer, a ceramic functional layer, and a metallic functional layer.

10. The press arrangement according to claim 7, wherein said pressure sensors are embedded in said cover or between said cover and said roll core.

11. The press arrangement according to claim 1, wherein said plurality of sensors comprise a first number of said pressure sensors arranged in a first region extending in the cross-machine direction over substantially a working width of said central roll, and an extent of said region in the circumferential direction is less than 30 cm.

12. The press arrangement according to claim 11, wherein said region in the circumferential direction is less than 15 cm.

13. The press arrangement according to claim 11, wherein said region in the circumferential direction is less than 5 cm.

14. The press arrangement according to claim 1, wherein at least one of said first and second mating pressing units is a press roll or a shoe press roll.

15. The press arrangement according to claim 14, wherein at least one of said press rolls is a deflection compensated press roll.

16. The press arrangement according to claim 1, wherein each of said first and second mating pressing units is a press roll and wherein one of said press rolls is a deflection compensated press roll and the other of said press rolls is not a deflection compensated press roll.

17. The press arrangement according to claim 1, wherein said first mating pressing unit is a press roll and said second mating pressing unit is a shoe press roll.

18. A method of measuring a pressure profile in a cross-machine direction in a press arrangement having at least two press nips, wherein a first press nip is formed between a first mating pressing unit and a central roll and a second press nip is formed between a second mating pressing unit and the central roll, and at least one of the two mating pressing units is a controlled deflection press roll or shoe press roll, and the central roll carries a plurality of pressure sensors arranged in the cross-machine direction, wherein the method comprises the following steps:

rotating the central roll so that the pressure sensors pass the first and second press nip;

issuing a trigger signal with a Hall sensor during a rotation of the central roll for determining a rotational position of the pressure sensors during a rotational movement of the central roll;

measuring a pressure profile in the first press nip and in the second press nip with the pressure sensors; and determining a hydraulic pressure of the holding arms of the mounting of the bearing journals and/or supporting rams for supporting a roll shell with respect to a supporting yoke of a mounting of the controlled deflection press roll or shoe press roll.

* * * * *